US006374742B1

(12) United States Patent
Brunn et al.

(10) Patent No.: US 6,374,742 B1
(45) **Date of Patent: *Apr. 23, 2002**

(54) METHOD OF PREPARING A LOW LETHALITY PROJECTILE FOR FLIGHT IN 37MM AND 40MM WEAPON SHELLS

(76) Inventors: Michael Brunn, 308 Littleworth La., Sea Cliff, NY (US) 11579; Jacob Kravel, 2 S. Circle Dr., Great Neck, NY (US) 11021

( * ) Notice: Subject to any disclaimer, the term of this patent is extended or adjusted under 35 U.S.C. 154(b) by 0 days.

This patent is subject to a terminal disclaimer.

(21) Appl. No.: 09/648,559

(22) Filed: Aug. 28, 2000

Related U.S. Application Data

(63) Continuation-in-part of application No. 09/434,453, filed on Nov. 5, 1999, now Pat. No. 6,202,562.

(51) Int. Cl.[7] ..... F42B 12/34
(52) U.S. Cl. ..... 102/502; 102/444
(58) Field of Search ..... 102/502, 444

(56) References Cited

U.S. PATENT DOCUMENTS 3,710,720 A * 1/1973 Mawhinney ..... 102/502
3,952,662 A * 4/1976 Greenlees ..... 102/502
4,823,702 A * 4/1989 Woolsey ..... 102/502
5,259,319 A * 11/1993 Dravecky ..... 102/444
5,450,795 A * 9/1995 Adelman ..... 102/444
5,750,918 A * 5/1998 Mangolds et al. ..... 102/502
6,202,562 B1 * 3/2001 Brunn et al. ..... 102/502

FOREIGN PATENT DOCUMENTS

EP 103509 * 3/1984 ..... 102/502

OTHER PUBLICATIONS

Product Update: 12 Gauge Bean Bag Rounds, by Bill Moles, Apr. 10, 2000.*

* cited by examiner

*Primary Examiner*—Harold J. Tudor
(74) *Attorney, Agent, or Firm*—Myron Amer P.C.

(57) ABSTRACT

An anti-personnel projectile launched from a 37 mm or 40 mm weapon shell required at impact to have a low lethality consequence, in which the projectile is fitted in the shell in a shape characterized by a blunt end in the direction of flight and maintained in this shape by oppositely directed air resistance and propelling forces to obviate a change of shape during flight that might cause a serious injury.

2 Claims, 1 Drawing Sheet

METHOD OF PREPARING A LOW LETHALITY PROJECTILE FOR FLIGHT IN 37MM AND 40MM WEAPON SHELLS

This application is a continuation-in-part of U.S. patent application Ser. No. 09/434,453, filed on Nov. 5, 1999, now U.S. Pat. No. 6,202,562.

The present invention relates generally to projectiles used primarily for low lethality anti-personnel end use, as for example for crowd control by a municipality police force, and more particularly relates to improvements for assuring that a projectile in use will have the requisite low lethality consequence upon impact, and thus avoiding unintentional severe injury to any individual.

EXAMPLE OF THE PRIOR ART

The need for low lethality projectiles is well known in the art, and additionally can be inferred from the promulgation by the National Institute of Justice of low lethality-qualifying standards exemplified by its standard 0101.03 tests. A known projectile which currently is a low lethality munition of choice consists of a flat bag which is folded in half to fit within a 12 gauge shotgun shell, and after exiting from the muzzle is supposed to unfold into a flat bag shape and impact in this flat bag shape upon a target. As such the kinetic energy is distributed over the area of the bag instead of at a point as in regular ammunition. As a consequence there is less of a possibility of an undesirable penetration while permitting the delivery of a desirable incapacitating impact.

The shape of the above described projectile at impact is not always predictable based solely on its construction as a bag, because the bag can be flat at impact only if it unfolds after exiting from the muzzle. However, on numerous occasions in practice it does not unfold and contacts a target with its folded together side edges and thus, with a shape that can, and often does, inflict serious injury. The inability to predict the projectile shape that will contact the target is believed to occur when several shapes are involved such as, in the case of the above described projectile, i.e., a first shape to accommodate the size dimensions to facilitate being loaded into the 12 gauge shotgun shell, and a second shape to achieve a low lethality consequence upon impact. Logic dictates that the need to change shapes during flight is a happenstance that perhaps most often will occur but which might not occur on occasion due to the shape-change complication.

Broadly, it is an object of the present invention to provide a low lethality anti-personnel projectile overcoming the foregoing and other shortcomings of the prior art.

More particularly, it is an object to impose a low lethality contacting surface of the projectile at impact by the manner in which it is loaded into a weapon shell, thus requiring no shape change but maintaining in flight the singular shape involved, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

By way of one example of many to serve as background in understanding the present invention, in police management of an unruly crowd, even kept at bay by a barricade, it often escalates to a confrontation between the police and an individual crossing the barricade, which necessitates management of the individual. It is police standard operating procedure to limit force in such a confrontation commsensurate to the d anger posed. A first and lowest level of force dictated by the circumstances would be to strike the individual, typically at eight to twenty yards, with a low lethality munition, i.e., a munition that does not fill or seriously maim the individual. If, however, continuing with the example, the individual withdraws a concealed weapon, the use of a lethal munition would be dictated.

Figure 4:
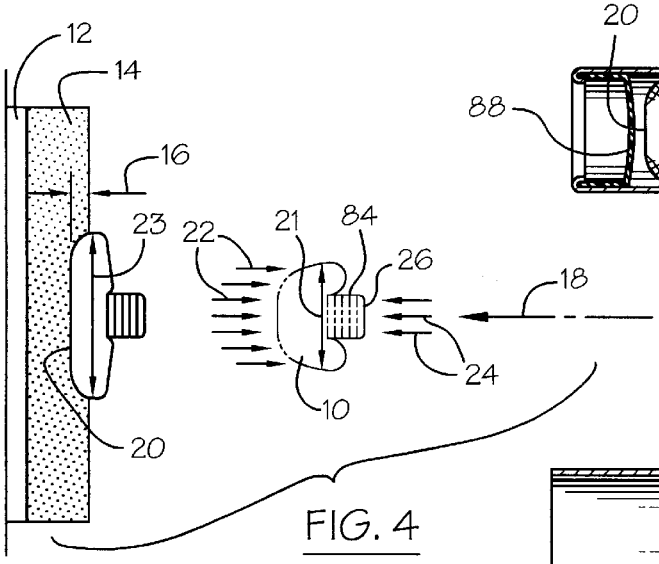
FIG. 4 is an elevational view showing, in full line, the shape of the projectile at impact, and in phantom perspective, the shape of the projectile in flight.

To qualify a munition as being of low lethality, and as best understood from FIG. 4, the projectile 10 is subjected to testing similar to the standard 0101.03 tests used by the National Institute of Justice, which 0101.03 tests to determine the effectiveness of, for example, a "bulletproof" vest measures the depth of deformation of a projectile in a known specific type of viscous clay. Thus, in the testing of projectile 10, there is applied on a target 12, a selected thickness of said known viscosity of clay 14 and it is required that in the typical range of confrontation that a projectile fired from a weapon (not shown) not penetrate the clay 14 beyond a specified depth 16, which currently is 40 mm.

Underlying the present invention is the recognition that projectile 10, although having physical attributes that might disqualify it as low lethality, can be shaped preparatory to being fired along a path of flight 18 to the target 12 with a blunt or flat end 20 and, most important, that this optimum shaped end 20 is effectively maintained during flight 18 by air resistant forces 22 exerted against the front or blunt end 20 of the projectile 10 and the opposite direction flight-propelling forces 24 exerted against the rear end 26 of the projectile 10. Stated some what differently, the opposing forces 22 and 24 maintain an interposed cylindrical shape 28 in the body of the projectile 10, and this shape 28 is characterized by the noted blunt end 20 and, as a result, does not impact upon the target 12 with a lethal consequence. In practice in fact, the opposite directional forces 22 and 24 cause the projectile blunt end 20 to undergo a progressive expanse during flight, as noted at 21, and at impact, as noted at 23.

Figure 1:
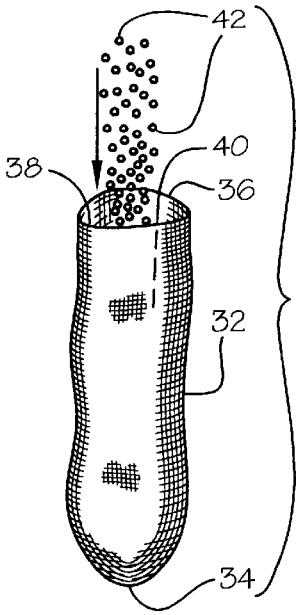
FIG. 1 is a perspective view of a projectile in accordance with the present invention in a work-in-process condition.
Figure 2:
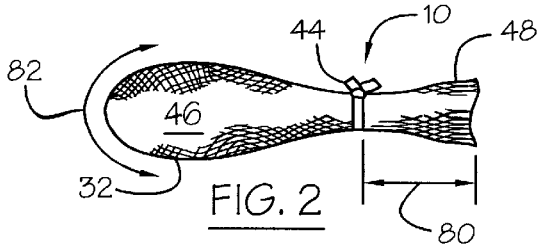
FIG. 2 is an elevational view of the constructed projectile preparatory to being loaded into a 37 mm weapon shell.

To achieve low lethality utility, projectile 10 is constructed using a tubular sock-like body of stretchable fabric construction material 32 having a closed front end 34 and a rear edge 36 bounding an opening 38 into a body compartment 40. In a work-in-process condition, as illustrated in FIG. 1, a selected amount of rubber pellets, individually and collectively designated 42, is inserted through the opening 38 to partially fill the compartment 40, particularly in the area of the closed end 34. As best shown in FIG. 2, the construction of the projectile 10 is completed by a tie or the like, as at 44, which delineates the rubber pellet-filled body 46 from a length portion or tail 48 of the fabric construction material 32.

Figure 3:
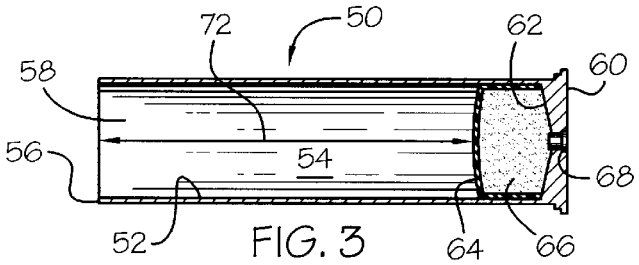
FIG. 3 is a longitudinal cross sectional view of an empty 37 mm weapon shell.
Figure 5:
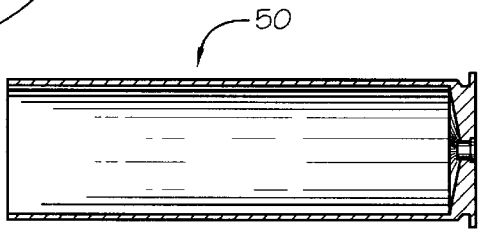
FIG. 5 is a view similar to FIG. 3, but of a 40 mm weapon shell.

To launch or propel the constructed projectile of FIG. 2, use is made of an empty weapon shell, which in FIG. 3 is selected for illustration to be a 37 mm weapon shell but which also could be a 40 mm weapon shell as illustrated in FIG. 5. The weapon used for the 37 mm shell is in the parlance of munitions a so-called riot or gas gun used by and for law enforcement, and the weapon used for the 40 mm shell, again in the parlance of munitions, is a so-called grenade launcher used by the military, and both these weapons and associated shells are intended to be referred to by the designation weapon shell(s). Each shell is generally designated 50, and the FIG. 3 illustration thereof having a cylindrical wall 52 bounding a compartment 54. Wall 52 has a front edge 56 bounding an opening 58 into the compartment 54 and a rear wall 60 serving as a closure for the compartment. Prior to loading the projectile 10 through the front opening 58 and into the compartment 54, there is positioned in the rear of casing 50 a plastic cap 64 which holds propellant 66 in combustible relation to a primer 68. In munitions parlance, the plastic cap 64 is generally known as a "wad," "pressure wad," or "gas wad," and functions like a piston, pushing the projectile out of the shell and down the barrel while containing the gasses behind it as well as protecting the projectile 10 against the heat of explosion.

For completeness' sake, it is noted that although the dimensions of the 37 mm weapon shell are well known, that these dimensions as related to the loading of the projectile 10 within the compartment 54 are a compartment length 72 of 3½ inches with the propellant 66 in place and a diameter 74 of approximately 1½ inches, and that the 40 mm weapon shell similarly has a compartment length of 3½ inches, not including the propellant 66, and a slightly larger diameter.

Similarly for completeness' sake, it is noted that in practice best results are achieved with a constructed projectile 10 having a length 76 from its closed end 34 to the applied tie of approximately 4 inches and, flattened by slight finger pressure, a maximum width 78 of approximately 2 inches. The tail 48 is cut to length 80 but preferably should not exceed 4 inches.

The bulk of the FIG. 2 constructed projectile 10 is then manually stuffed through the front opening 58 into the compartment 54 which, not only of course properly positions the projectile 10 for firing, but also reshapes the projectile 10 so it can qualify for low lethality end use. Without this reshaping, the curvature shape 82 of the projectile front end 34 would penetrate the field-testing clay 14 beyond the depth 16, and thus disqualify the projectile 10 as a low lethality munition.

Figure 3A:
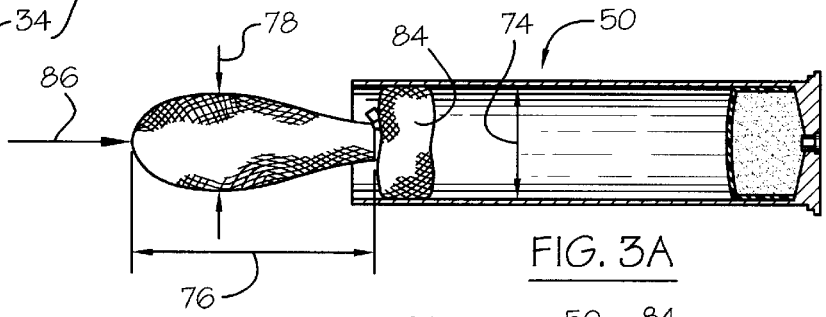
FIGS. 3A and 3B are similarly longitudinal cross sectional views, but showing, in sequence, the loading of the projectile of FIG. 2 into the 37 mm weapon shell of FIG. 3.

In the preferred loading sequence of the projectile 10 into the shell compartment 54, the tail 48 is folded into a resulting bulk, as at 84, and in this folded configuration is urged in movement 86 into the compartment 54, as illustrated in FIG. 3A. Continuing to apply the force 86, the rubber pellet-filled projectile front 34 is worked fully into the compartment 54, as illustrated in FIG. 3B, aided by rotational twists of the projectile front end 34 in addition to the longitudinally directed force 86.

Alternatively, the projectile 10 can be inserted through a funnel (not shown); preferably tail first, and will assume a folded configuration as a result of being compressed between the rubber pellet-filled body 32 and the rear confines of the shell 50. After either loading sequence, the shell front end opening 58 in then closed in a well known fashion by an appropriate closure 88 appropriately seated and held in place in the end opening 58.

Figure 3B:
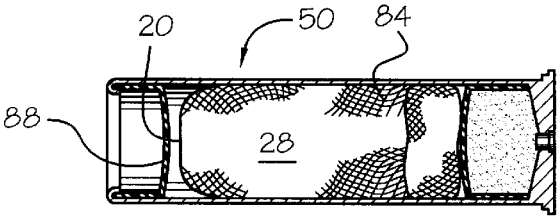

The propellant 66 is then ignited, in a well understood manner, by the primer 68 which, also in a well understood manner, causes the projectile 10 in the shape illustrated in FIG. 3B and is characterized by a blunt-shaped front end 20, reshaped therein to from a curvature shape 82, to be launched along a path of movement 18 for eventual impact against the target 12 wherein the forces 22 and 24 maintain the blunt shape of the front end 34 during flight movement 18 and, consequently also at impact.

It should be noted that force 24 exists as an applied influence on the shaping of the projectile 10 during flight as a result of the reaction to the decelerating force 22, but not as part of the force causing the projectile 10 to be accelerated down the barrel of the launching weapon which, as generally understood, is a force of the expanding gas phenomenon of the ignited primer 68, since said expanding gas force ceases when the projectile 10 exits from the weapon barrel.

It is further to be noted that the projectile 10 requires ballast which as hereinbefore noted preferably is to consist of rubber pellets 42 which in practice provides a desired volume, a weight not exceeding 60 grams in the size fabric body 32 noted and is particulate in nature. However, it is to be understood that particulate ballast pellets of materials other than rubber can be used and provide similar projectile weight and volume to achieve a low lethality consequence.

While the apparatus for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A method of shaping a projectile so as to have a specified low lethality consequence upon impact against an individual, said shaping method comprising the steps of using an empty 37 mm weapon shell having a cylindrical wall bounding a projectile compartment and a front edge bounding a front opening into said projectile compartment and having a rear wall serving as a closure for said projectile compartment, positioning projectile-propelling explosive means adjacent said projectile compartment closure, using preliminarily an unfilled tubular sock-like projectile body of fabric construction material having a closed front end and a rear edge bounding a rear opening therein to, filling through said rear opening of said tubular sock-like projectile body a selected amount of rubber pellets to assume a position therein against said closed end, forming folds in said tubular sock-like projectile body inmediately forward of said rear opening thereof, inserting said formed folds of said tubular sock-like projectile body into said projectile compartment front opening, urging in movement said rubber pellet-filled closed front end of said tubular sock-like projectile body fully into said projectile compartment to an extent causing said formed folds thereof into firm contact against said projectile propelling explosive means and said rubber pellet-filled closed front end to expand radially into contact with said 37 mm weapon shell cylindrical wall so as to assume said cylindrical shape thereof characterized by a blunt front end, and igniting said projectile-propelling means, whereby said tubular sock-like projectile body exits from said 37 mm weapon shell projectile compartment in said blunt-ended cylindrical shape against a force of air resistance to flight exerted against a front thereof and pushed by a force urging said shape in flight exerted against a rear thereof such that said blunt-ended cylindrical shape is maintained during flight and at impact to thereby contribute to a low lethality consequence.

2. A method of shaping a projectile so as to have a specified low lethality consequence upon impact against an individual, said shaping method comprising the steps of using an empty 40 mm weapon shell having a cylindrical wall bounding a projectile compartment and a front edge bounding a front opening into said projectile compartment and having a rear wall serving as a closure for said projectile compartment, positioning projectile-propelling explosive means adjacent said projectile compartment closure, using preliminarily an unfilled tubular sock-like projectile body of fabric construction material having a closed front end and a rear edge bounding a rear opening therein to, filling through said rear opening of said tubular sock-like projectile body a selected amount of rubber pellets to assume a position therein against said closed end, forming folds in said tubular sock-like projectile body immediately forward of said rear opening thereof, inserting said formed folds of said tubular sock-like projectile body into said projectile compartment front opening, urging in movement said rubber pellet-filled closed front end of said tubular sock-like projectile body fully into said projectile compartment to an extent causing said formed folds thereof into firm contact against said projectile propelling explosive means and said rubber pellet-filled closed front end to expand radially into contact with said 40 mm weapon shell cylindrical wall so as to assume said cylindrical shape thereof characterized by a blunt front end, and igniting said projectile-propelling means, whereby said tubular sock-like projectile body exits from said 40 mm weapon shell projectile compartment in said blunt-ended cylindrical shape against a force of air resistance to flight exerted against a front thereof and pushed by a force urging said shape in flight exerted against a rear thereof such that said blunt-ended cylindrical shape is maintained during flight and at impact to thereby contribute to a low lethality consequence.

* * * * *